US009396890B2

(12) United States Patent
Smeltzer et al.

(10) Patent No.: US 9,396,890 B2
(45) Date of Patent: Jul. 19, 2016

(54) ELECTRICAL SWITCHING APPARATUS, AND ARC CHUTE ASSEMBLY AND BARRIER MEMBER THEREFOR

(71) Applicant: EATON CORPORATION, Cleveland, OH (US)

(72) Inventors: James Michael Smeltzer, Salem, OH (US); John Edward Devine, Pittsburgh, PA (US); James Patrick Sisley, Baden, PA (US)

(73) Assignee: EATON CORPORATION, Cleveland, OH (US)

( * ) Notice: Subject to any disclaimer, the term of this patent is extended or adjusted under 35 U.S.C. 154(b) by 205 days.

(21) Appl. No.: 14/288,424

(22) Filed: May 28, 2014

(65) Prior Publication Data

US 2015/0348720 A1 Dec. 3, 2015

(51) Int. Cl.

| | |
|---|---|
| ***H01H 9/36*** | (2006.01) |
| ***H01H 9/34*** | (2006.01) |
| *H01H 71/02* | (2006.01) |

(52) U.S. Cl.

CPC . *H01H 9/34* (2013.01); *H01H 9/36* (2013.01); *H01H 71/0207* (2013.01)

(58) Field of Classification Search

CPC ..... H01H 9/34; H01H 34/36
USPC ..... 218/15, 34, 40, 41, 149, 151
See application file for complete search history.

(56) References Cited

U.S. PATENT DOCUMENTS 3,031,552 A * 4/1962 Stewart ..... H01H 9/34 218/151
5,861,596 A 1/1999 Grass et al.
6,248,970 B1 * 6/2001 DiMarco ..... H01H 9/34 218/151
6,703,576 B1 3/2004 Chou et al.
7,521,645 B2 4/2009 Shea et al.
7,674,996 B2 3/2010 Shea et al.

(Continued)

FOREIGN PATENT DOCUMENTS

EP 1 655 752 A2 5/2006
EP 2 393 095 A2 12/2011

OTHER PUBLICATIONS

European Patent Office, "International Search Report and Written Opinion", Jun. 10, 2015, 11 pp.

*Primary Examiner* — Amy Cohen Johnson
*Assistant Examiner* — Marina Fishman
(74) *Attorney, Agent, or Firm* — Eckert Seamans Cherin & Mellott, LLC; John P. Powers; Grant E. Coffield

(57) ABSTRACT

A barrier member is for an arc chute assembly of an electrical switching apparatus. The arc chute assembly comprises a first sidewall and a second sidewall opposite and spaced apart from said first sidewall. The barrier member comprises a body portion structured to be disposed between said first sidewall and said second sidewall, said body portion comprising a first support portion, a second support portion, and a cover portion connecting said first support portion to said second support portion; a first containment portion extending from said first support portion, said first containment portion being structured to be disposed proximate said first sidewall; and a second containment portion extending from said second support portion toward said first containment portion, said second containment portion being structured to be disposed proximate said second sidewall, wherein said second containment portion is spaced from said first containment portion.

20 Claims, 4 Drawing Sheets

(56) References Cited
U.S. PATENT DOCUMENTS 8,247,727 B2 8/2012 Zhou et al.
8,847,096 B2 * 9/2014 Juds ..... H01H 9/443
218/23
2008/0192400 A1 8/2008 Lafon
2014/0061160 A1 3/2014 Juds et al.

* cited by examiner

ELECTRICAL SWITCHING APPARATUS, AND ARC CHUTE ASSEMBLY AND BARRIER MEMBER THEREFOR

BACKGROUND

1. Field

The disclosed concept pertains generally to electrical switching apparatus. The disclosed concept also pertains to arc chute assemblies for electrical switching apparatus. The disclosed concept further relates to barrier members for arc chute assemblies.

2. Background Information

Electrical switching apparatus, such as circuit breakers, provide protection for electrical systems from electrical fault conditions such as, for example, current overloads, short circuits, and abnormal level voltage conditions.

Circuit breakers, for example, typically include a set of stationary electrical contacts and a set of movable electrical contacts. The stationary and movable electrical contacts are in physical and electrical contact with one another when it is desired that the circuit breaker energize a power circuit. When it is desired to interrupt the power circuit, the movable contacts and stationary contacts are separated. Upon initial separation of the movable contacts away from the stationary contacts, an electrical arc is formed in the space between the contacts. The arc provides a means for smoothly transitioning from a closed circuit to an open circuit, but produces a number of challenges to the circuit breaker designer. Among them is the fact that the arc results in the undesirable flow of electrical current through the circuit breaker to the load. Additionally, the arc, which extends between the contacts, often results in vaporization or sublimation of the contact material itself. Therefore, it is desirable to extinguish any such arcs as soon as possible upon their propagation.

To facilitate this process, circuit breakers typically include arc chute assemblies which are structured to attract and break-up the arcs. Specifically, the movable contacts of the circuit breaker are mounted on arms that are contained in a pivoting assembly which pivots the movable contacts past or through arc chutes as they move into and out of electrical contact with the stationary contacts. Each arc chute includes a plurality of spaced apart arc plates mounted in a wrapper. As the movable contact is moved away from the stationary contact, the movable contact moves past the ends of the arc plates, with the arc being magnetically drawn toward and between the arc plates. The arc plates are electrically insulated from one another such that the arc is broken-up and extinguished by the arc plates.

Additionally, along with the generation of the arc itself, ionized gases, which can cause excessive heat and additional arcing and, therefore, harm to electrical components, are formed as a byproduct of the arcing event. The ionized gases can undesirably cause the arc to bypass a number of intermediate arc plates as it moves through the arc chute. This reduces the number of arc voltage drops and the effectiveness of the arc chute. It also creates current and gas flow patterns that tend to collapse groups of arc plates together, further reducing the voltage divisions in the arc chute and its cooling effectiveness. Additionally, debris, such as, for example, molten metal particles, are created during the arcing event and can collect in the gaps between arc plates, causing an electrical short, and high current levels during current interruption generate high magnetic forces, which attract the arc plates together.

There is thus room for improvement in electrical switching apparatus, and in arc chute assemblies and barrier members therefor.

SUMMARY

These needs and others are met by embodiments of the disclosed concept wherein a barrier member is provided which among other benefits, controls the flow of ionized gases in an arc chute assembly of an electrical switching apparatus.

In accordance with one aspect of the disclosed concept, a barrier member for an arc chute assembly of an electrical switching apparatus is provided. The arc chute assembly comprises a first sidewall, a second sidewall opposite and spaced apart from the first sidewall, and a plurality of arc plates disposed between the first sidewall and the second sidewall. The arc chute assembly is structured to be disposed in the electrical switching apparatus. The electrical switching apparatus comprises a housing and a pair of separable contacts enclosed by the housing. The contacts are structured to trip open. An arc and ionized gases are generated in response to the contacts tripping open. The barrier member comprises a body portion structured to be disposed between the first sidewall and the second sidewall, the body portion comprising a first support portion, a second support portion, and a cover portion connecting the first support portion to the second support portion; a first containment portion extending from the first support portion, the first containment portion being structured to be disposed proximate the first sidewall; and a second containment portion extending from the second support portion toward the first containment portion, the second containment portion being structured to be disposed proximate the second sidewall. The second containment portion is spaced from the first containment portion.

As another aspect of the disclosed concept, an arc chute assembly for an electrical switching apparatus is provided. The electrical switching apparatus includes a housing and a pair of separable contacts enclosed by the housing. The separable contacts are structured to trip open. An arc and ionized gases are generated in response to the separable contacts tripping open. The arc chute assembly comprises a plurality of retaining components comprising a first sidewall and a second sidewall opposite and spaced apart from the first sidewall; a plurality of arc plates disposed between the first sidewall and the second sidewall; and a barrier member comprising: a body portion disposed between the first sidewall and the second sidewall, the body portion comprising a first support portion, a second support portion, and a cover portion connecting the first support portion to the second support portion; a first containment portion extending from the first support portion, the first containment portion being disposed proximate the first sidewall; and a second containment portion extending from the second support portion toward the first containment portion, the second containment portion being disposed proximate the second sidewall. The second containment portion is spaced from the first containment portion.

As another aspect of the disclosed concept, an electrical switching apparatus comprises a housing; separable contacts enclosed by the housing; an operating mechanism structured to open and close the separable contacts and to trip open the separable contacts in response to an electrical fault; and at least one arc chute assembly disposed at or about the separable contacts in order to attract and dissipate an arc and ionized gases which are generated by the separable contacts tripping open in response to the electrical fault, the at least one arc chute assembly comprising: a plurality of retaining components comprising a first sidewall and a second sidewall opposite and spaced apart from the first sidewall; a plurality of arc plates disposed between the first sidewall and the second sidewall; and a barrier member comprising: a body portion disposed between the first sidewall and the second sidewall, the body portion comprising a first support portion, a second support portion, and a cover portion connecting the first support portion to the second support portion; a first containment portion extending from the first support portion, the first containment portion being disposed proximate the first sidewall; and a second containment portion extending from the second support portion toward the first containment portion, the second containment portion being disposed proximate the second sidewall. The second containment portion is spaced from the first containment portion.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1A:
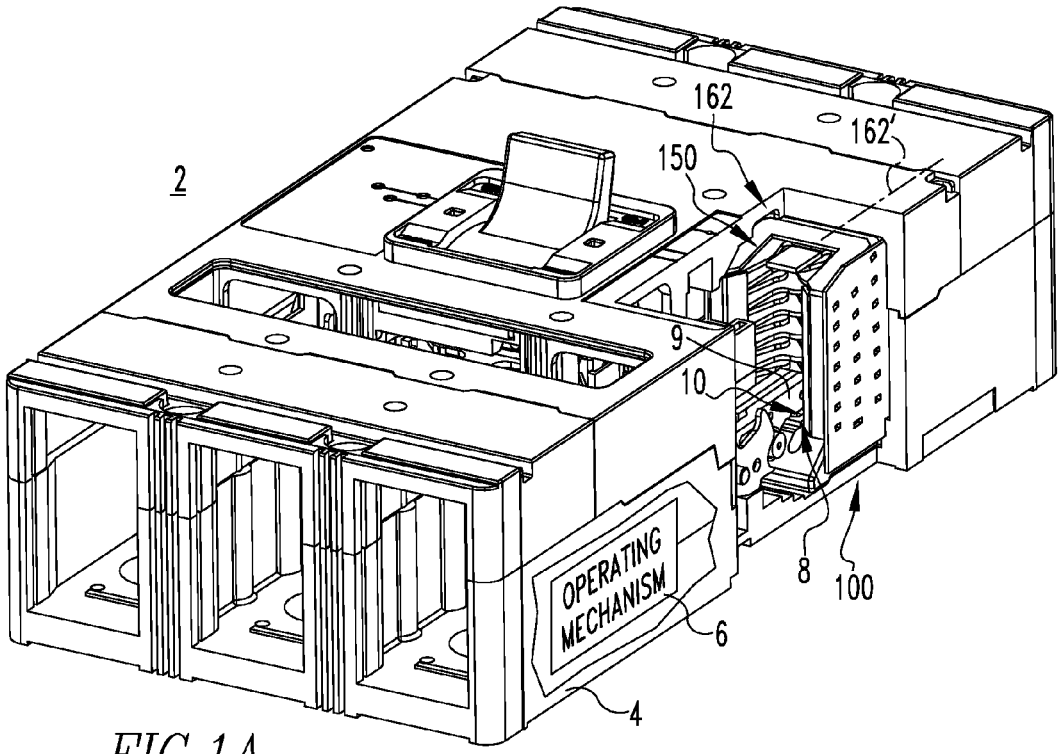
FIG. 1A is an isometric view of an electrical switching apparatus, and arc chute assembly and barrier member therefor, in accordance with an embodiment of the disclosed concept, shown in the closed position with a portion of the housing cutaway to show hidden structures.
Figure 1B:
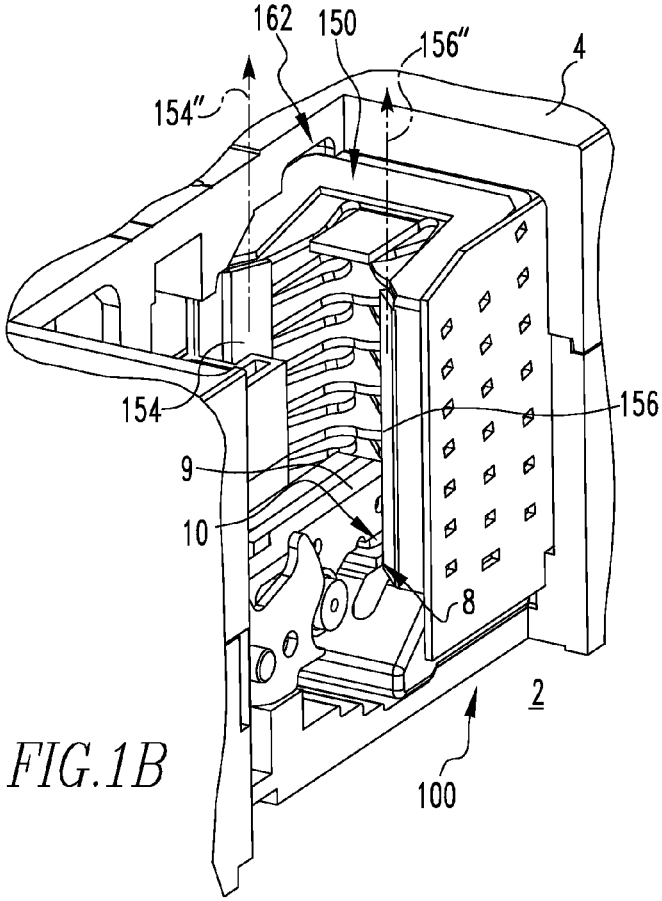
FIG. 1B is an enlarged isometric view of a portion of the electrical switching, and arc chute assembly and barrier member therefor of FIG. 1A.

For purposes of the description hereinafter, directional phrases used herein such as, for example, "top", "bottom", "front", "back", "behind", "side", "right", "left", "upper", "lower", and derivatives thereof shall relate to the disclosed concept, as it is oriented in the drawings. It is to be understood that the specific elements illustrated in the drawings and described in the following specification are simply exemplary embodiments of the disclosed concept. Therefore, specific orientations and other physical characteristics related to the embodiments disclosed herein are not to be considered limiting with respect to the scope of the disclosed concept.

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

As employed herein, the statement that two or more parts or components "engage" one another shall mean that the parts touch and/or exert a force against one another either directly or through one or more intermediate parts or components.

Figure 2A:
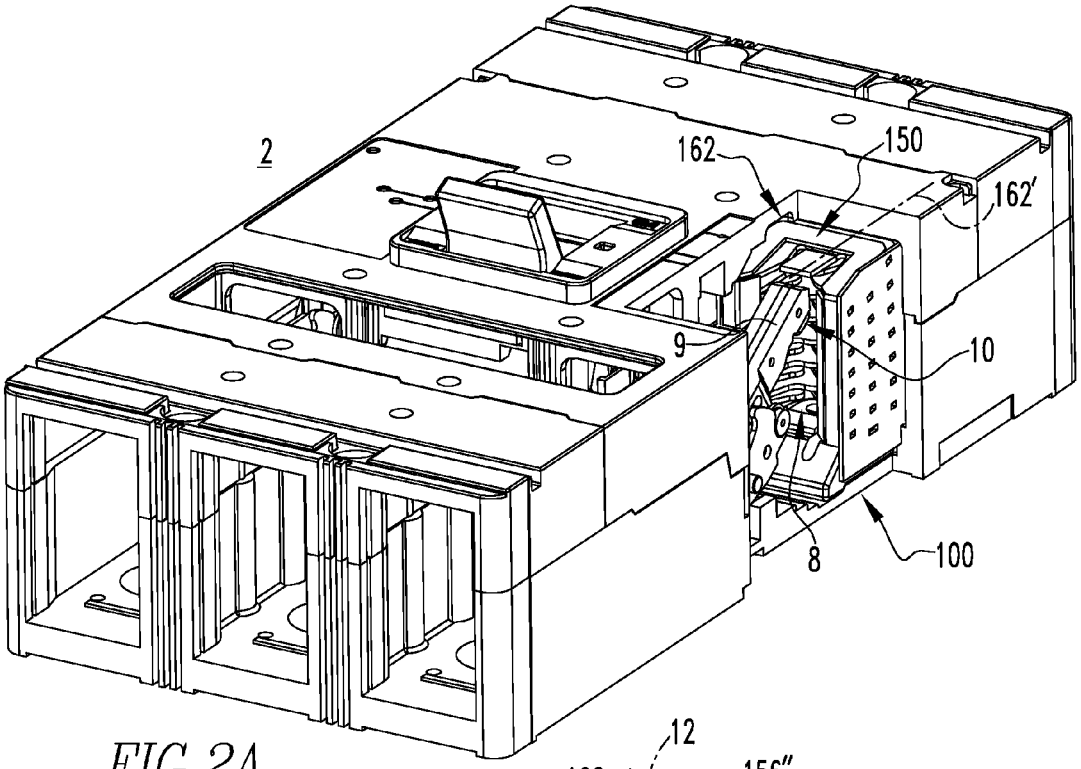
FIG. 2A is an isometric view of the electrical switching apparatus, and arc chute assembly and barrier member therefor of FIG. 1A, modified to show the electrical switching apparatus in the open position.
Figure 2B:
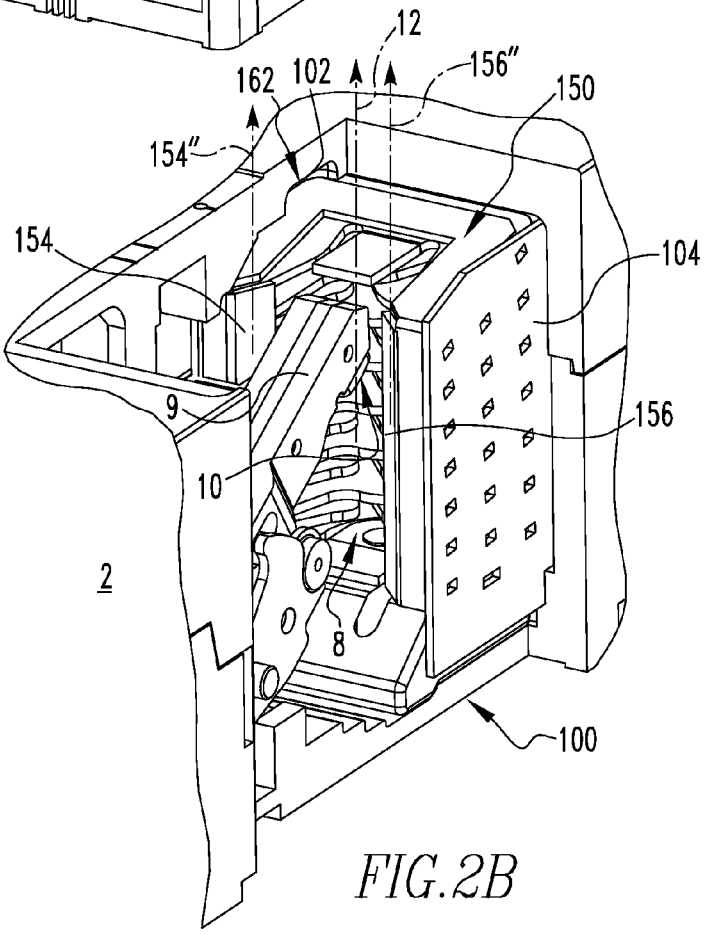
FIG. 2B is an enlarged isometric view of a portion of the electrical switching apparatus, and arc chute assembly and barrier member therefor of FIG. 2A.

FIG. 1A shows an electrical switching apparatus (e.g., without limitation, mining circuit breaker 2) in a closed position. The circuit breaker 2 includes a housing 4, an operating mechanism 6 (shown in simplified form), a stationary contact 8, a contact arm 9, and a movable contact 10 connected to the contact arm 9. The housing 4 encloses the operating mechanism 6, the contacts 8,10, and the contact arm 9. In operation, the operating mechanism 6 trips the contact arm 9 in response to an electrical fault condition, thus moving the movable contact 10 from the closed position, in which it engages the stationary contact 8, to an open position (FIG. 2A and FIG. 2B), in which the movable contact 10 is spaced from the stationary contact 8. As the movable contact 10 moves from the closed position to the open position, an arc flash event occurs due to the separation between the movable contact 10 and the stationary contact 8. Additionally, ionized gases are formed as a byproduct of the arcing event. In order to attract and dissipate the arc and ionized gases generated by the tripping of the contacts 8,10, and control the arc flash flow direction of the ionized gases, the circuit breaker 2 includes an arc chute assembly 100 near the contacts 8,10.

The example circuit breaker 2 shown and described herein is a multiple pole circuit breaker 2. It will be appreciated that the circuit breaker 2 may employ any number of arc chute assemblies for each of the poles of the circuit breaker 2. Additionally, although the disclosed concept is being described in association with the multiple pole circuit breaker 2, it will be appreciated that a single pole circuit breaker (not shown) may employ an arc chute assembly (not shown) in accordance with the disclosed concept in a similar manner as described herein, to control the arc flash flow direction of ionized gases given off during an arcing event.

Figure 3A:
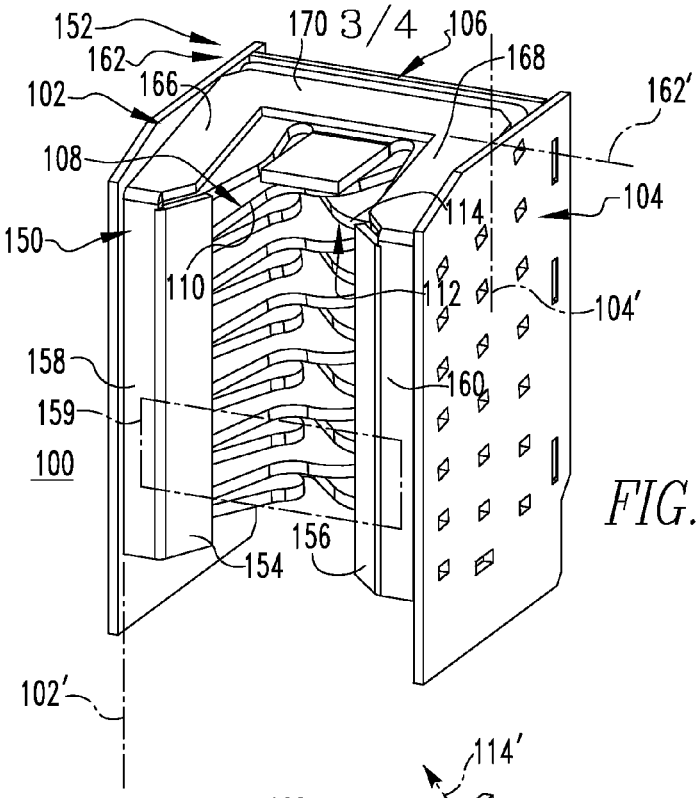
FIG. 3A is an isometric view of the arc chute assembly of FIG. 2B.
Figure 3B:
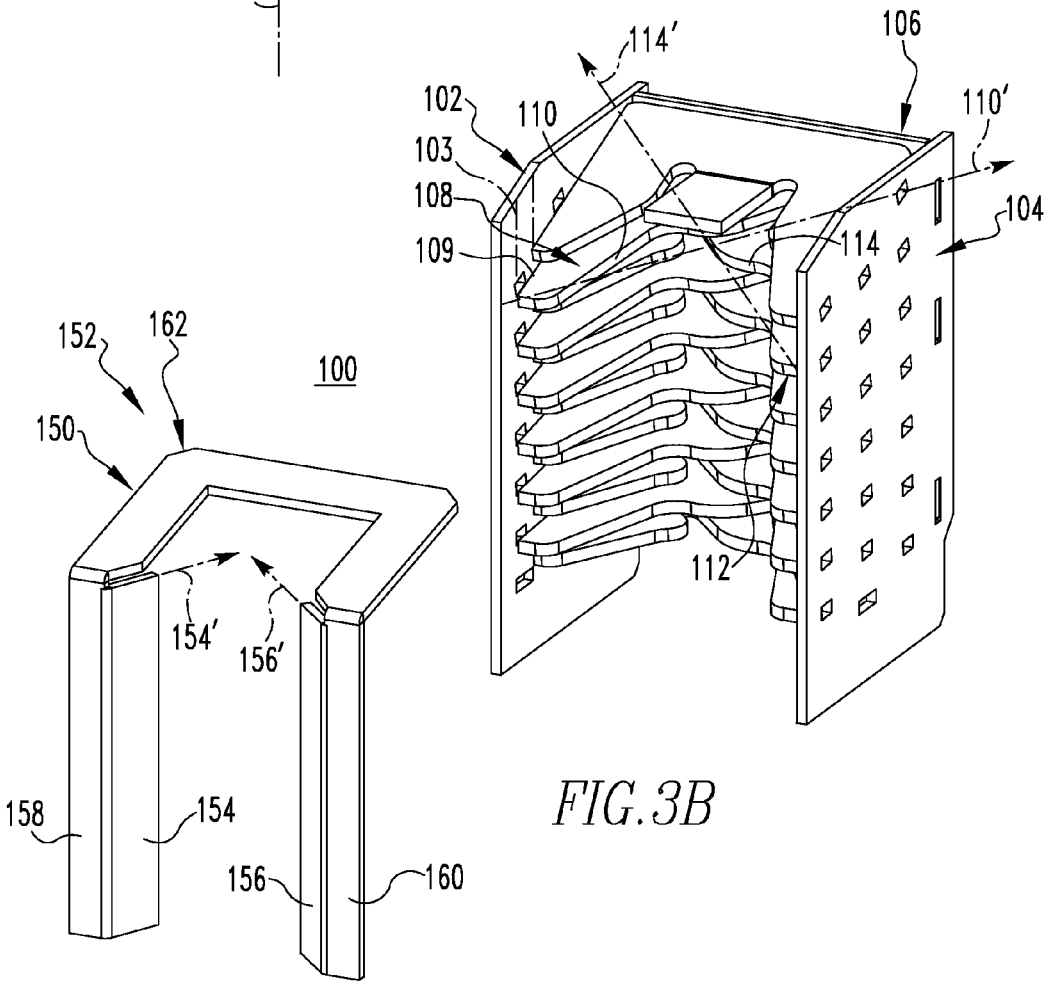
FIG. 3B is an exploded isometric view of the arc chute assembly of FIG. 3A.

Referring to FIG. 3A and FIG. 3B, the arc chute assembly 100 includes a plurality of retaining components (e.g., without limitation, opposing and spaced apart sidewalls 102, 104, and base 106 extending between the sidewalls 102,104). The arc chute assembly 100 further includes a plurality of arc plates (two arc plates 108,112 are indicated) and a barrier member 150, each being located between the sidewalls 102, 104. The barrier member 150 is preferably press fit between the sidewalls 102,104, advantageously allowing for a secure connection with the sidewalls 102,104, without requiring an additional separate fastening mechanism, means or method.

It is, however, also within the scope of the disclosed concept for the barrier member 150 to engage the sidewalls 102,104 in a manner other than being press fit. For example, and without limitation, the barrier member 150 may be slot connected with the first sidewall 102 and/or slot connected with the second sidewall 104 (see, e.g., slot 103 schematically shown in simplified form extending along the top of the first sidewall 102 in FIG. 3B). It is within the scope of the disclosed concept for the barrier member 150 to have a protrusion (not shown) that extends into the slot 103, thereby allowing for a relatively strong connection. In operation, as ionized gases given off from the tripping of the contacts 8,10 engage the barrier member 150, such a strong connection between the barrier member 150 and the sidewalls 102,104, be it by a press fit connection, by a slot connection or any other suitable secure engagement, advantageously enables the barrier member 150 to remain secure within the arc chute assembly 100.

The barrier member 150 includes a body portion 152 and a pair of containment portions (e.g., without limitation, elongated flaps 154,156). The body portion 152 includes a pair of support portions 158,160 and a cover portion 162 connecting the first support portion 158 to the second support portion 160. The first elongated flap 154 extends from the first support portion 158 and is located near the first sidewall 102. The second elongated flap 156 extends from the second support portion 160 and is located near the second sidewall 104. Furthermore, the second elongated flap 156 extends toward the first elongated flap 154 and is spaced from the first elongated flap 154. In operation, as ionized gases given off during an arc flash event flow throughout the arc chute assembly 100, the elongated flaps 154,156 create a self-sealing effect. In other words, and with reference to FIG. 2B, after the ionized gases reach the sidewalls 102,104, the elongated flaps 154, 156 block the ionized gases, thus preventing them from re-striking the contact arm 9. This minimizes contact degradation and prevents dielectric breakdown, advantageously allowing for higher interruption capability of the circuit breaker 2.

Referring to FIG. 3B, the arc plate 108 includes an edge 109 that engages the sidewall 102, and an edge 110 extending therefrom toward the base 106 in a direction 110'. The arc plate 112 similarly includes an edge (not shown) that engages the sidewall 104 and an edge 114 extending therefrom toward the base 106 in a direction 114'. The directions 110',114' are each preferably at an angle with respect to the corresponding sidewall 102,104 of between 30 degrees and 60 degrees, and more preferably between 40 degrees and 50 degrees. Additionally, the first elongated flap 154 of the barrier member 150 extends from the first support portion 158 in a direction 154' substantially parallel to the direction 110'. Likewise, the second elongated flap 156 extends from the second support portion 160 in a direction 156' substantially parallel to the direction 114'. As seen in FIG. 3A, the edge 110 of the arc plate 108 is substantially located between the first elongated flap 154 and the first sidewall 102. Similarly, the edge 114 of the arc plate 112 is substantially located between the second elongated flap 156 and the second sidewall 104.

In operation, this configuration of the arc plates 108,112 and the elongated flaps 154,156 further creates the self-sealing effect. More specifically, ionized gases given off by the tripping of the contacts 8,10 (FIG. 1A through FIG. 2B) located near the edge 110 of the arc plate 108 will advantageously be contained between the first elongated flap 154 and the first sidewall 102, thereby avoiding re-striking to the contact arm 9. For example, the first elongated flap 154 may engage the edge 110 of the arc plate 108, thereby completely sealing a potential pathway for ionized gases, which would otherwise re-strike the contact arm 9. Similarly, ionized gases located near the arc plate 112 will advantageously be contained between the second elongated flap 156 and the second sidewall 104, thereby avoiding re-striking the contact arm 9.

As seen in FIG. 3A, the first sidewall 102 is located in a plane 102' and the second sidewall 104 is located in a plane 104'. Additionally, the cover portion 162 is located in a plane 162' and the support portions 158,160 are located in a plane 159 (e.g., the first support portion 158 is coplanar with the second support portion 160). The planes 159,162' are each normal to the planes 102',104' of the sidewalls 102,104. Such a configuration advantageously allows for a relatively secure connection between the barrier member 150 and the sidewalls 102,104.

Additionally, the cover portion 162 includes a number of elongated portions 166,168,170. The first elongated portion 166 extends from the first support portion 158 and the second elongated portion 168 extends from the second support portion 160. The third elongated portion 170 connects the first elongated portion 166 to the second elongated portion 168 and is normal to each of the first elongated portion 166 and the second elongated portion 168. Furthermore, the third elongated portion 170 is elongated in a direction normal to the planes 102',104'. By having generally parallel opposing sides (e.g., the first support portion 158 and the first elongated portion 166 are generally parallel with respect to the second support portion 160 and the second elongated portion 168), and by having the elongated flaps 154,156, the support portions 158, 160, and the cover portion 162 be planar, manufacturing of the barrier member 150 is advantageously simplified. For example and without limitation, a flat unitary piece of metal (not shown) can be die cut and simply bent into the desired shape, as shown for example and without limitation, in FIGS. 4A-5.

Furthermore, although the disclosed concept has been described in association with the cover portion 162 including the elongated portions 166,168,170, it is within the scope of the disclosed concept for the cover portion 162 to include other configurations (e.g., without limitation, a generally continuous square shaped cover portion (not shown)). Additionally, although the disclosed concept has been described in association with the planar elongated flaps 154,156, it is within the scope of the disclosed concept to employ alternative flaps (not shown). For example and without limitation, it is within the scope of the disclosed concept to employ flaps (not shown) in an arc chute assembly (not shown) that are concave towards the sidewalls 102,104. Moreover, it is within the scope of the disclosed concept to employ elongated flaps (not shown) in an arc chute assembly (not shown) with roughened or corrugated surfaces.

Figure 4A:
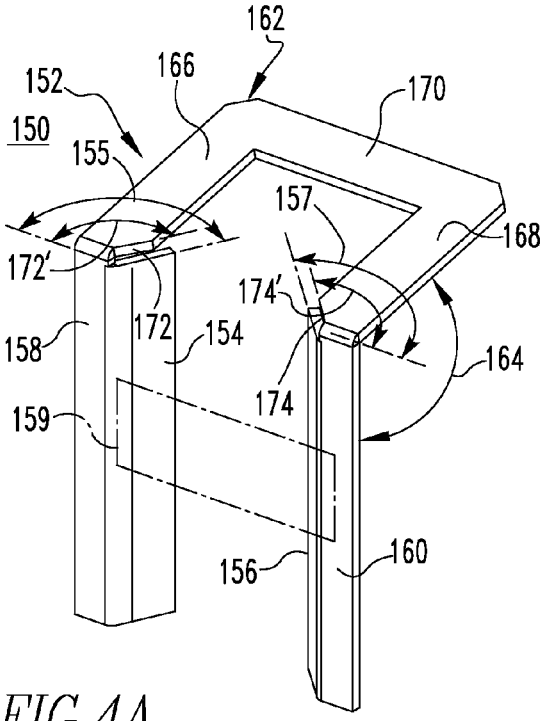
FIGS. 4A and 4B are isometric views of the barrier member for the arc chute assembly of FIG. 3B.
Figure 4B:
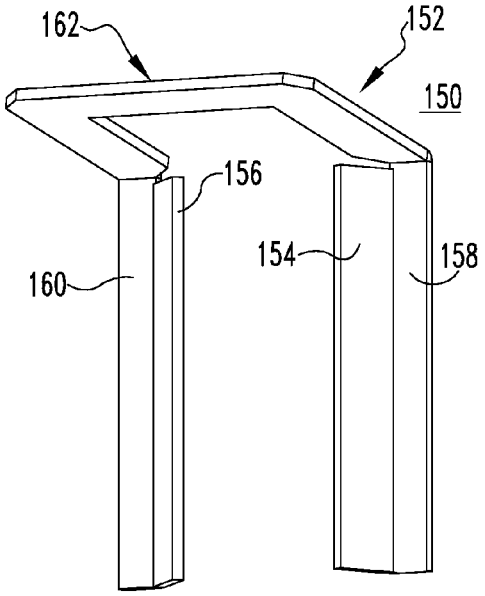

Referring to FIG. 4A, there is an angle 155 between the first support portion 158 and the first elongated flap 154. Likewise, there is an angle 157 between the second support portion 160 and the second elongated flap 156. The angles 155,157 are preferably between 120 degrees and 150 degrees, and more preferably being between 130 degrees and 140 degrees. The self-sealing effect of the ionized gases is optimized by orienting the elongated flaps 154,156 as such with respect to the support portions 158,160.

Furthermore, the first elongated portion 166 includes an end surface 172 that extends from the first support portion 158 at an angle 172'. Likewise, the second elongated portion 168 includes an end surface 174 that extends from the second support portion 160 at an angle 174'. The angles 172',174', like the angles 155,157, are preferably between 120 degrees and 150 degrees, and more preferably being between 130 degrees and 140 degrees. In this manner, the elongated flaps 154,156 are advantageously able to extend inwardly toward the base 106 (FIG. 3A and FIG. 3B) all the way to the end surfaces 172,174 of the cover portion 162. This further improves the self-sealing effect, as the ionized gases will be prevented from traveling from the sidewalls 102,104 to the contact arm 9 by way of an opening proximate the end surfaces 172,174.

As seen in FIG. 4A, the cover portion 162 is at an angle 164 with respect to plane 159 of the support portions 158,160. The angle 164 is preferably between 75 degrees and 105 degrees. As a result, the cover portion 162 substantially extends over and covers the arc plates 108,112 (FIG. 3A and FIG. 3B), advantageously aiding in preventing ionized gases given off from tripping of the contacts 8,10 (FIGS. 1A through 2B) from exiting the top of the arc chute assembly 100 and into the circuit breaker 2.

Figure 5:
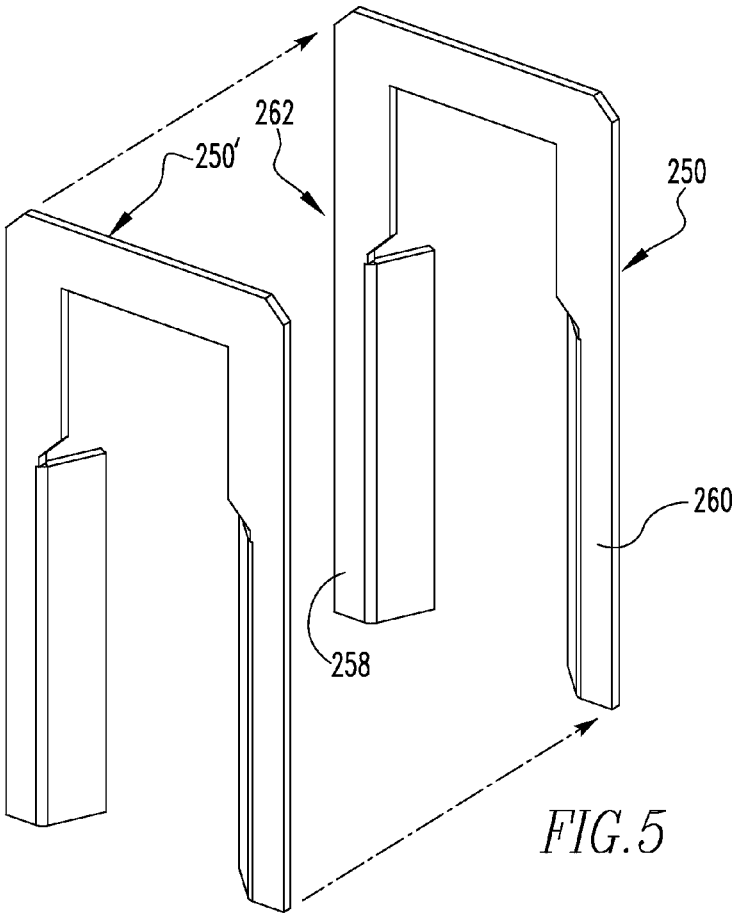
FIG. 5 is an isometric view of a pair of barrier members for the arc chute assembly of FIG. 3B, each shown prior to being completely formed.

FIG. 5 shows an isometric view of a barrier member 250, shown prior to being fully formed. As seen, the barrier member 250 includes a pair of support portions 258,260 and a cover portion 262. During manufacturing, the cover portion 262 is bent toward the support portions 258,260 to be brought into final shape (see, e.g., barrier member 150 of FIGS. 3B, 4A and 4B). FIG. 5 also shows another barrier member 250' that has not been fully formed. In this state, the barrier members 250,250' are able to be nested with one another. Thus, shipping is advantageously simplified and costs saved as the barrier members 250,250' are able to be more efficiently stacked with one another.

Referring again to FIG. 1B, the first elongated flap 154 is elongated in a direction 154" and the second elongated flap 156 is elongated in a direction 156". As the movable contact 10 moves from the closed position (FIG. 1B) to the open position (FIG. 2B), the movable contact 10 moves toward the cover portion 162 in a direction 12 (FIG. 2B) parallel to the directions 154",156". As the movable contact 10 moves from the open position to the closed position, the movable contact 10 moves away from the cover portion 162. Additionally, each of the contacts 8,10 is located between the elongated flaps 154,156. Accordingly, it will be appreciated that the disclosed concept advantageously results in a more controlled flow of ionized gases given off by the tripping of the contacts 8,10 throughout the arc chute assembly 100.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A barrier member for an arc chute assembly of an electrical switching apparatus, said arc chute assembly comprising a first sidewall, a second sidewall opposite and spaced apart from said first sidewall, and a plurality of arc plates disposed between said first sidewall and said second sidewall, said arc chute assembly being structured to be disposed in said electrical switching apparatus, said electrical switching apparatus comprising a housing, a pair of separable contacts enclosed by said housing, and an operating mechanism structured to open and close said separable contacts and to trip open said separable contacts in response to an electrical fault, an arc and ionized gases being generated in response to said separable contacts tripping open, said barrier member comprising:

a body portion structured to be disposed between said first sidewall and said second sidewall, said body portion comprising a first support portion, a second support portion, and a cover portion connecting said first support portion to said second support portion;

a first containment portion extending from said first support portion, said first containment portion being structured to be disposed proximate said first sidewall; and a second containment portion extending from said second support portion toward said first containment portion, said second containment portion being structured to be disposed proximate said second sidewall, wherein said second containment portion is spaced from said first containment portion, wherein said barrier member is a unitary component made from a single piece of material, and wherein said barrier member overlays and spans across said plurality of arc plates.

2. The barrier member of claim 1 wherein said first support portion is coplanar with said second support portion.

3. The barrier member of claim 2 wherein said cover portion is disposed in a plane; wherein the plane of said cover portion intersects said first support portion and said second support portion at an angle of between 75 degrees and 105 degrees.

4. The barrier member of claim 1 wherein said first containment portion is a first elongated flap extending from said first support portion; and wherein said second containment portion is a second elongated flap extending from said second support portion.

5. The barrier member of claim 4 wherein said first elongated flap is disposed at a first angle with respect to said first support portion; wherein said second elongated flap is disposed at a second angle with respect to said second support portion; and wherein each of said first angle and said second angle is between 120 degrees and 150 degrees.

6. The barrier member of claim 1 wherein said cover portion comprises a first elongated portion, a second elongated portion, and a third elongated portion; wherein said first elongated portion is parallel to said second elongated portion and spaced therefrom; wherein said third elongated portion connects said first elongated portion to said second elongated portion and is normal with respect thereto; wherein said first elongated portion extends from said first support portion; and wherein said second elongated portion extends from said second support portion.

7. The barrier member of claim 6 wherein said first elongated portion has a first end surface; wherein said second elongated portion has a second end surface; wherein each of said first containment portion and said first end surface extend from said first support portion at a first angle; wherein each of said second containment portion and said second end surface extend from said second support portion at a second angle; and wherein each of said first angle and said second angle is between 120 degrees and 150 degrees.

8. An arc chute assembly for an electrical switching apparatus including a housing, a pair of separable contacts enclosed by said housing, and an operating mechanism structured to open and close said separable contacts and to trip open said separable contacts in response to an electrical fault, an arc and ionized gases being generated in response to said separable contacts tripping open, said arc chute assembly comprising:

a plurality of retaining components comprising a first sidewall and a second sidewall opposite and spaced apart from said first sidewall;

a plurality of arc plates disposed between said first sidewall and said second sidewall; and a barrier member comprising:

a body portion disposed between said first sidewall and said second sidewall, said body portion comprising a first support portion, a second support portion, and a cover portion connecting said first support portion to said second support portion;

a first containment portion extending from said first support portion, said first containment portion being disposed proximate said first sidewall; and a second containment portion extending from said second support portion toward said first containment portion, said second containment portion being disposed proximate said second sidewall, wherein said second containment portion is spaced from said first containment portion, wherein said barrier member is a unitary component made from a single piece of material, and wherein said barrier member overlays and spans across said plurality of arc plates.

9. The arc chute assembly of claim 8 wherein said cover portion comprises a first elongated portion, a second elongated portion, and a third elongated portion; wherein said first elongated portion is spaced from said second elongated portion and parallel with respect thereto; wherein said third elongated portion connects said first elongated portion to said second elongated portion; wherein said first elongated portion extends from said first support portion; wherein said second elongated portion extends from said second support portion; and wherein said third elongated portion is elongated in a direction normal to said first sidewall and said second sidewall.

10. The arc chute assembly of claim 8 wherein said barrier member is press fit between said first sidewall and said second sidewall.

11. The arc chute assembly of claim 8 wherein said barrier member is slot connected with said first sidewall.

12. The arc chute assembly of claim 11 wherein said barrier member is slot connected with said second sidewall.

13. The arc chute assembly of claim 8 wherein said first sidewall is disposed in a plane; wherein said second sidewall is disposed in a plane substantially parallel with said plane of said first sidewall; and wherein said cover portion is disposed in a plane normal to said plane of said first sidewall and said plane of said second sidewall.

14. The arc chute assembly of claim 13 wherein each of said first support portion and said second support portion is disposed in a plane normal to said plane of said first sidewall and said plane of said second sidewall.

15. The arc chute assembly of claim 8 wherein said plurality of retaining components further comprises a base extending between said first sidewall and said second sidewall; wherein said plurality of arc plates comprises a first arc plate and a second arc plate; wherein said first arc plate includes a first edge engaging said first sidewall and a second edge extending from said first edge toward said base in a first direction; wherein said second arc plate includes a third edge engaging said second sidewall and a fourth edge extending from said third edge toward said base in a second direction; wherein said first containment portion extends from said first support portion toward said base in a direction substantially parallel to said first direction; and wherein said second containment portion extends from said second support portion toward said base in a direction substantially parallel to said second direction.

16. The arc chute assembly of claim 15 wherein said second edge is substantially disposed between said first containment portion and said first sidewall; and wherein said fourth edge is substantially disposed between said second containment portion and said second sidewall.

17. An electrical switching apparatus comprising:

a housing;

separable contacts enclosed by said housing;

an operating mechanism structured to open and close said separable contacts and to trip open said separable contacts in response to an electrical fault; and at least one arc chute assembly disposed at or about said separable contacts in order to attract and dissipate an arc and ionized gases which are generated by said separable contacts tripping open in response to said electrical fault, said at least one arc chute assembly comprising:

a plurality of retaining components comprising a first sidewall and a second sidewall opposite and spaced apart from said first sidewall;

a plurality of arc plates disposed between said first sidewall and said second sidewall; and a barrier member comprising:

a body portion disposed between said first sidewall and said second sidewall, said body portion comprising a first support portion, a second support portion, and a cover portion connecting said first support portion to said second support portion;

a first containment portion extending from said first support portion, said first containment portion being disposed proximate said first sidewall; and a second containment portion extending from said second support portion toward said first containment portion, said second containment portion being disposed proximate said second sidewall, wherein said second containment portion is spaced from said first containment portion, wherein said barrier member is a unitary component made from a single piece of material, and wherein said barrier member overlays and spans across said plurality of arc plates.

18. The electrical switching apparatus of claim 17 wherein said first containment portion is a first flap elongated in a first direction; wherein said second containment portion is a second flap elongated in a second direction; wherein said separable contacts comprise a stationary contact and a movable contact; wherein said movable contact is structured to move in a direction parallel to each of said first direction and said second direction; and wherein each of said stationary contact and said movable contact is disposed between said first flap and said second flap.

19. The electrical switching apparatus of claim 17 wherein said separable contacts comprise a stationary contact and a movable contact; wherein said movable contact is structured to move between a closed position and an open position; wherein as said movable contact moves from said closed position to said open position, said movable contact moves toward said cover portion; and wherein as said movable contact moves from said open position to said closed position, said movable contact moves away from said cover portion.

20. The electrical switching apparatus of claim 17 wherein said electrical switching apparatus is a circuit breaker having a plurality of poles; and wherein said at least one arc chute assembly comprises a plurality of arc chute assemblies for the poles of said circuit breaker.

* * * * *